US006258015B1

(12) United States Patent
Blackford et al.

(10) Patent No.: US 6,258,015 B1
(45) Date of Patent: Jul. 10, 2001

(54) EXERCISE DEVICE

(76) Inventors: Richard Blackford, P.O. Box 17502, Sarasota, FL (US) 34276; Steven S. Harvey, 4912 Kilty Ct. East, Bradenton, FL (US) 34203; Clifton Y. Sherwood, 629 N. Tamiami Trail, Venice, FL (US) 34292

( * ) Notice: Subject to any disclaimer, the term of this patent is extended or adjusted under 35 U.S.C. 154(b) by 0 days.

(21) Appl. No.: 09/695,890

(22) Filed: Oct. 25, 2000

(51) Int. Cl.[7] ..... A63B 21/02
(52) U.S. Cl. ..... 482/124; 482/121; 600/38
(58) Field of Search ..... 482/148, 121, 482/124, 122, 44, 49; 600/38; 601/46, 23

(56) References Cited

U.S. PATENT DOCUMENTS 3,687,458 * 8/1972 Proctor, Jr. ..... 273/183 D
3,926,178 * 12/1975 Feldzamen ..... 128/2 S
4,572,503 2/1986 Myung Ho .
5,372,557 12/1994 Ostingny .
5,865,715 2/1999 Wallick .

* cited by examiner

*Primary Examiner*—Stephen R. Crow

(57) ABSTRACT

An exercise device has first and second components with a hinge coupling the proximal ends of the components. The first component has a cone shaped distal region, a semi-cylindrical shaped proximal region, and a generally flat intermediate region. A recess is formed between the distal region and the proximal end. The second component has a thin disc-shaped distal region, a semi-cylindrical proximal region, and a generally flat intermediate region. The second component is positionable within the recess of the first component. An enlarged annular collar has a first half on the first component between the intermediate and proximal regions and a second half on the second component between the distal and proximal regions and has a radius of curvature greater than the radius of curvature of the proximal regions. A spring urges the first and second components into the open orientation during use.

4 Claims, 3 Drawing Sheets

FIG 1
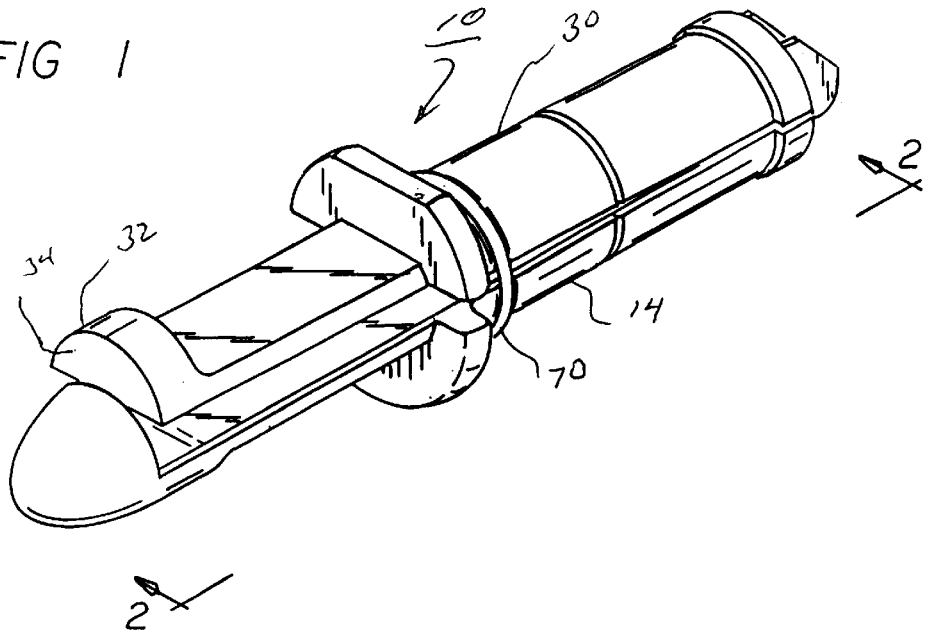
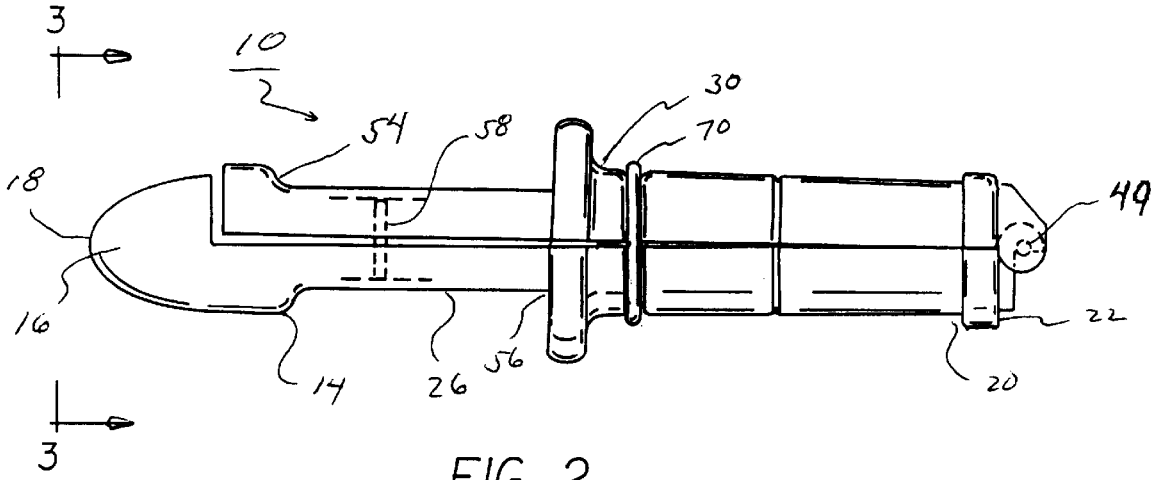
FIG 2

FIG 3
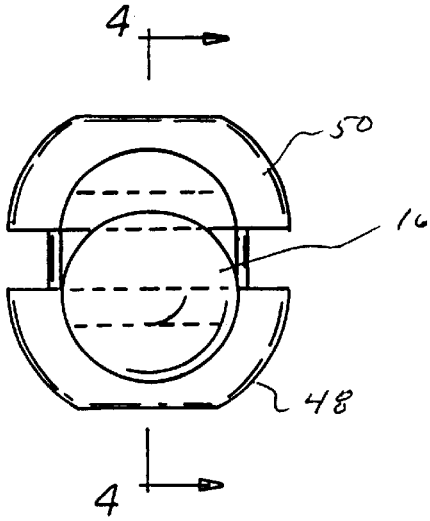
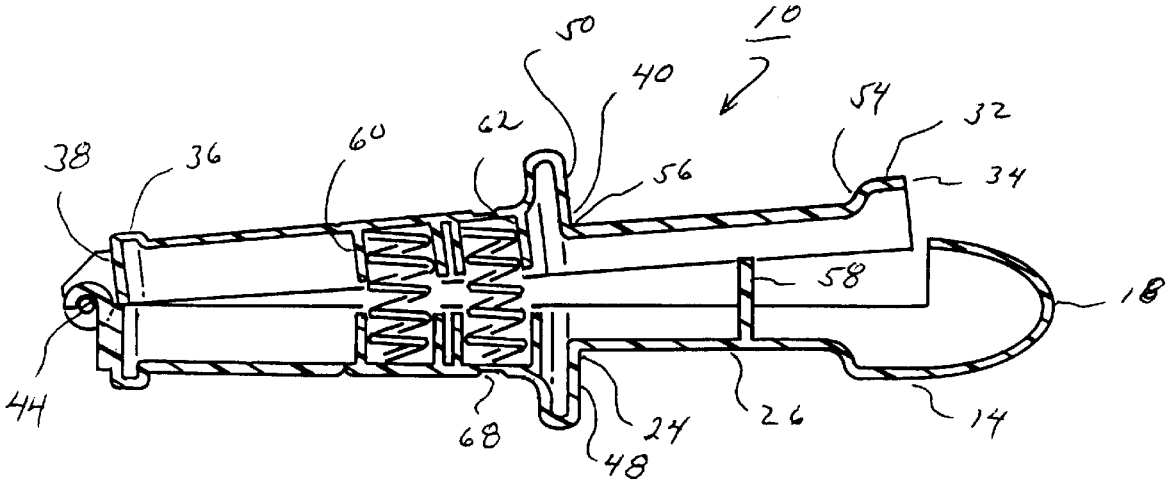
FIG 4

EXERCISE DEVICE

BACKGROUND OF THE INVENTION

1. Field of the Invention

The present invention relates to an exercise device and more particularly pertains to strengthening a user's vaginal muscles while precluding the over insertion of an exercise device during use.

2. Description of the Prior Art

The use of exercise devices of known designs and configurations is known in the prior art. More specifically, exercise devices of known designs and configurations previously devised and utilized for the purpose of strengthening muscles through known exercise methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,865,715 to Wallick discloses a contraction resistance vaginal muscle exerciser. U.S. Pat. No. 5,372,557 issued Dec. 13, 1994, to Ostigay disclose a hand, wrist and forearm exerciser. Lastly, U.S. Pat. No. 4,752,503 to Ho relates to pivotal skipping rope handles having spring resistance.

While these devices fulfill their respective, particular objectives and requirements, the aforementioned patents do not describe an exercise device that allows strengthening a user's vaginal muscles while precluding the over insertion of an exercise device during use.

In this respect, the exercise device according to the present invention substantially departs from the conventional concepts and designs of the prior art, and in doing so provides an apparatus primarily developed for the purpose of strengthening a user's vaginal muscles while precluding the over insertion of an exercise device during use.

Therefore, it can be appreciated that there exists a continuing need for a new and improved exercise device which can be used for strengthening a user's vaginal muscles while precluding the over insertion of an exercise device during use.

In this regard, the present invention substantially fulfills this need.

SUMMARY OF THE INVENTION

In view of the foregoing disadvantages inherent in the known types of exercise devices of known designs and configurations now present in the prior art, the present invention provides an improved exercise device. As such, the general purpose of the present invention, which will be described subsequently in greater detail, is to provide a new and improved exercise device and method which has all the advantages of the prior art and none of the disadvantages.

To attain this, the present invention essentially comprises a first component, a second component and a hinge. The first component is about 190 millimeters plus or minus 10 percent in length. The first component has a distal region with a distal end and a proximal region with a proximal end. The first component also has an intermediate region between the distal region and the proximal regions. The distal region is formed in a cone shaped configuration with a maximum radius of curvature of about 16 millimeters plus or minus 10 percent spaced about 25 millimeters plus or minus 10 percent from the distal end. The proximal region is formed in a semi-cylindrical shaped configuration with a constant radius of curvature of about 16 millimeters plus or minus 10 percent spaced continuously from about 91 millimeters plus or minus 10 percent from the proximal end. The intermediate region is formed in a generally flat configuration with a constant width of about 32 millimeters plus or minus 10 percent spaced between the proximal region and the distal region. A recess is formed between the distal region and the proximal end. A second component is next provided. The second component is about 166 millimeters plus or minus 10 percent in length and has a distal region with a distal end and a proximal region with a proximal end. The second component also has an intermediate region between the distal region and the proximal region. The distal region is formed in a thin disc shaped configuration with a maximum radius of curvature of about 16 millimeters plus or minus 10 percent. The proximal region is formed in a semi-cylindrical shaped configuration with a constant radius of curvature of about 16 millimeters plus or minus 10 percent spaced continuously from about 91 millimeters plus or minus 10 percent from the proximal end. The intermediate region is formed in a generally flat configuration with a constant width of about 32 millimeters plus or minus 10 percent spaced between the proximal region and the distal region. The second component is positionable within the recess of the first component. Next provided is a hinge. The hinge is coupled to the proximal ends of the first and the second components. The hinge provides for the pivotally coupling and rotational movement between an open orientation with the second component spaced from the first component and a closed orientation wherein the second component is within the recess of the first component with the semi cylindrical regions of the first and second components form an essentially cylindrical shape and with the flat portions of the first and second components parallel with respect to each other. An enlarged annular collar is next provided. The collar has a first half on the first component between the intermediate and proximal regions. The collar also has a second half on the second component between the distal and proximal regions. The annular collar is co-axial with the first and second components when in the closed orientation with a radius of curvature of about 25 millimeters which is greater than the radius of curvature of the proximal regions and with an axial length of about 5.0 millimeters and with flat surfaces above and below. Next provided is a distal transition region between the distal and intermediate regions of the first and second components. The distal transition region is formed in a conical configuration. The distal transition region functions to facilitate insertion and removal of the device. Also provided is a proximal transition region between the collar halves and the intermediate regions of the first and second components. The proximal transition region is formed in right angle cross sectional configuration. The proximal transition region functions to preclude over insertion of the device during use. A post extends upwardly form the first component to contact a central extent of the second component when in the closed orientation to preclude pinching during operation and use. Two pair of hollow cylinders are next provided. The hollow cylinders are within the proximal regions of the first and second components. Each pair of hollow cylinders is in axial alignment when in the closed orientation. A pair of coil springs are provided within the hollow cylinders. The coil springs function to urge the first and second components into the open orientation during use. Lastly, an annular groove is provided. The annual groove is within the exterior surfaces of the proximal regions of the first and second components adjacent to the collar halves. An associated elastomeric O-ring is provided.

The O-ring is positionable within the annular groove. The O-ring functions to hold the first and second components in the closed orientation during storage and transportation. The O-ring is removable when in use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise device which has all of the advantages of the prior art exercise devices of known designs and configurations and none of the disadvantages.

It is another object of the present invention to provide a new and improved exercise device which may be easily and efficiently manufactured and marketed.

It is further object of the present invention to provide a new and improved exercise device which is of durable and reliable constructions.

An even further object of the present invention is to provide a new and improved exercise device which is susceptible of a low cost of manufacture with regard to both materials and labor, and which accordingly is then susceptible of low prices of sale to the consuming public, thereby making such exercise device economically available to the buying public.

Even still another object of the present invention is to provide an exercise device for strengthening a user's vaginal muscles while precluding the over insertion of an exercise device during use.

Lastly, it is an object of the present invention to provide a new and improved exercise device which has first and second components and a hinge coupling the proximal ends of the components. The first component has a cone shaped distal region, a semi-cylindrical shaped proximal region, and a generally flat intermediate region. A recess is formed between the distal region and the proximal end. The second component has a thin disc-shaped distal region, a semi-cylindrical proximal region, and a generally flat intermediate region. The second component is positionable within the recess of the first component. An enlarged annular collar has a first half on the first component between the intermediate and proximal regions and a second half on the second component between the distal and proximal regions and has a radius of curvature greater than the radius of curvature of the proximal regions. A spring urges the first and second components into the open orientation during use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of exercise device constructed in accordance with the principles of the present invention.

FIG. 2 is a side elevational view taken along line 2—2 of FIG. 1.

FIG. 3 is a front elevational view taken along line 3—3 of FIG. 2.

FIG. 4 is a cross sectional view of the device taken along line 4—4 of FIG. 3.

The same reference numerals refer to the same parts throughout the various Figures.

DESCRIPTION OF THE PREFERRED EMBODIMENT

Figure 5:
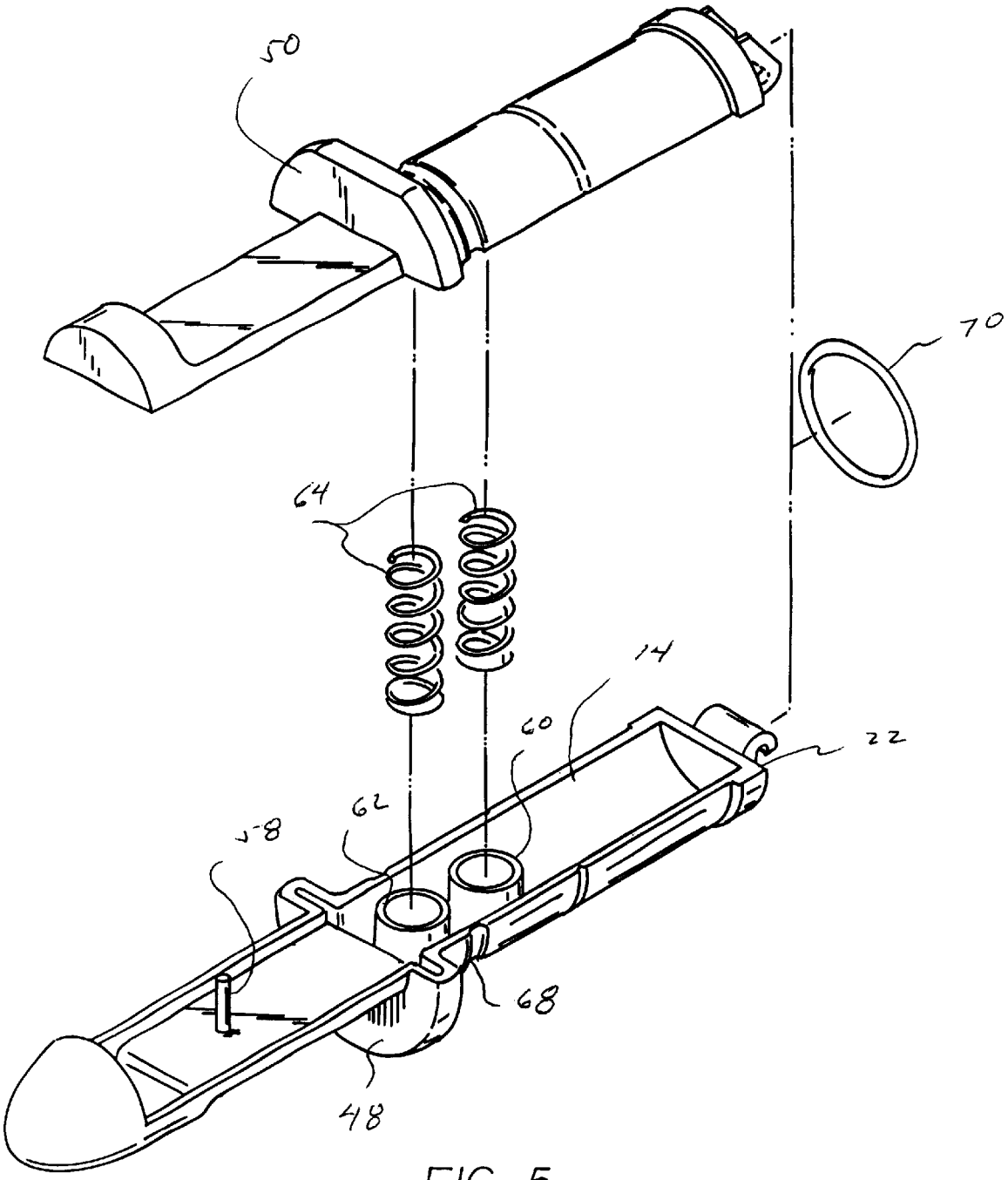
FIG. 5 is an exploded perspective illustration of the device of the previous Figures.

With reference now to the drawings, and in particular to FIG. 1 thereof, the preferred embodiment of the new and improved exercise device embodying the principles and concepts of the present invention and generally designated by the reference numeral 10 will be described.

The present invention, the exercise device 10 is comprised of a plurality of components. Such components in their broadest context include a first component, a second component, a hinge, an enlarged annular collar and a spring. Such components are individually configured and correlated with respect to each other so as to attain the desired objective.

First provided is a first component 14. The first component is about 190 millimeters plus or minus 10 percent in length. The first component has a distal region 16 with a distal end 18 and a proximal region 20 with a proximal end 22. The first component also has an intermediate region 24 between the distal region and the proximal regions. The distal region is formed in a cone shaped configuration with a maximum radius of curvature of about 16 millimeters plus or minus 10 percent spaced about 25 millimeters plus or minus 10 percent from the distal end. The proximal region is formed in a semi-cylindrical shaped configuration with a constant radius of curvature of about 16 millimeters plus or minus 10 percent spaced continuously from about 91 millimeters plus or minus 10 percent from the proximal end. The intermediate region is formed in a generally flat configuration with a constant width of about 32 millimeters plus or minus 10 percent spaced between the proximal region and the distal region. A recess 26 is formed between the distal region and the proximal end.

A second component 30 is next provided. The second component is about 166 millimeters plus or minus 10 percent in length and has a distal region 32 with a distal end 34 and a proximal region 36 with a proximal end 38. The second component also has an intermediate region 40 between the distal region and the proximal region. The distal region is formed in a thin disc shaped configuration with a maximum radius of curvature of about 16 millimeters plus or minus 10 percent. The proximal region is formed in a semi-cylindrical shaped configuration with a constant radius of curvature of about 16 millimeters plus or minus 10 percent spaced continuously from about 91 millimeters plus or minus 10 percent from the proximal end. The intermediate region is formed in a generally flat configuration with a constant width of about 32 millimeters plus or minus 10 percent spaced between the proximal region and the distal region. The second component is positionable within the recess of the first component.

Next provided is a hinge 44. The hinge is coupled to the proximal ends of the first and the second components. The hinge provides for the pivotally coupling and rotational movement between an open orientation with the second component spaced from the first component and a closed orientation wherein the second component is within the recess of the first component with the semi cylindrical regions of the first and second components form an essentially cylindrical shape and with the flat portions of the first and second components parallel with respect to each other.

An enlarged annular collar is next provided. The collar has a first half 48 on the first component between the intermediate and proximal regions. The collar also has a second half 50 on the second component between the distal and proximal regions. The annular collar is co-axial with the first and second components when in the closed orientation with a radius of curvature of about 25 millimeters which is greater than the radius of curvature of the proximal regions and with an axial length of about 5.0 millimeters and with flat surfaces above and below.

Next provided is a distal transition region 54 between the distal and intermediate regions of the first and second components. The distal transition region is formed in a conical configuration. The distal transition region functions to facilitate insertion and removal of the device. Also provided is a proximal transition region 56 between the collar halves and the intermediate regions of the first and second components. The proximal transition region is formed in right angle cross sectional configuration. The proximal transition region functions to preclude over insertion of the device during use for safety purposes.

Additional safety is provided by a post 58. Such post is formed to extend upwardly from the first component in a central extent. When in the closed orientation, the top of the post will contact a central extent of the second component to preclude the edges of the components form contacting each other to thereby eliminate the pinching of the user's skin during use.

Two pair of hollow cylinders 60, 62 are next provided. The hollow cylinders are within the proximal regions of the first and second components. Each pair of hollow cylinders is in axial alignment when in the closed orientation. A pair of coil springs 64 are provided within the hollow cylinders. The coil springs function to urge the first and second components into the open orientation during use.

Lastly, an annular groove 68 is provided. The annual groove is within the exterior surfaces of the proximal regions of the first and second components adjacent to the collar halves. An associated elastomeric O-ring is provided. The O-ring is positionable within the annular groove. The O-ring functions to hold the first and second components in the closed orientation during storage and transportation. The O-ring is removable when in use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise device for strengthening a user's vaginal muscles while precluding the over insertion of the device during use comprising, in combination:

a first component about 190 millimeters plus or minus 10 percent in length and having a distal region with a distal end and a proximal region with a proximal end and an intermediate region there between, the distal region being formed in a cone shaped configuration with a maximum radius of curvature of about 16 millimeters plus or minus 10 percent spaced about 25 millimeters plus or minus 10 percent from the distal end, the proximal region being formed in a semi-cylindrical shaped configuration with a constant radius of curvature of about 16 millimeters plus or minus 10 percent spaced continuously from about 91 millimeters plus or minus 10 percent from the proximal end, the intermediate region being formed in a generally flat configuration with a constant width of about 32 millimeters plus or minus 10 percent spaced between the proximal region and the distal region, the first component forming a recess between the distal region and the proximal end;

a second component about 166 millimeters plus or minus 10 percent in length and having a distal region with a distal end and a proximal region with a proximal end and an intermediate region there between, the distal region being formed in a thin disc shaped configuration with a maximum radius of curvature of about 16 millimeters plus or minus 10 percent, the proximal region being formed in a semi-cylindrical shaped configuration with a constant radius of curvature of about 16 millimeters plus or minus 10 percent spaced continuously from about 91 millimeters plus or minus 10 percent from the proximal end, the intermediate region being formed in a generally flat configuration with a constant width of about 32 millimeters plus or minus 10 percent spaced between the proximal region and the distal region, the second component being positionable within the recess of the first component;

a hinge coupling to the proximal ends of the first and the second components for the pivotal coupling and rotational movement between an open orientation with the second component spaced from the first component and a closed orientation wherein the second component is within the recess of the first component with the semi cylindrical regions of the first and second components form an essentially cylindrical shape and with the flat portions of the first and second components parallel with respect to each other;

an enlarged annular collar having a first half on the first component between the intermediate and proximal regions and a second half on-the second component between the distal and proximal regions, the annular collar being co-axial with the first and second components when in the closed orientation with a radius of curvature of between about 25 millimeters plus or minus 10 percent which is greater than the radius of curvature of the proximal regions and an axial length of about 5.0 millimeters and with flat surfaces above and below;

a distal transition region with a conical configuration between the distal and intermediate regions of the first and second components to facilitate insertion and removal of the device and proximal transition region with a right angle cross sectional configuration between the collar halves and the intermediate regions of the first and second components to preclude over insertion of the device during use;

a post extending upwardly from the intermediate region of the first component to contact a central extent of the intermediate region of the second component when in the closed orientation to preclude pinching during operation and use;

two pair of hollow cylinders within the proximal regions of the first and second components, each pair being in axial alignment when in the closed orientation and with a pair of coil springs there within urging the first and second components into the open orientation during use; and an annular groove within the exterior surfaces of the proximal regions of the first and second components adjacent to the collar halves and with an associated elastomeric O-ring positionable there within to hold the first and second components in the closed orientation during storage and transportation but removable therefrom when in use.

2. An exercise device comprising:

a first component having a distal region and a proximal region and an intermediate region there between, the distal region being formed in a cone shaped configuration, the proximal region being formed in a semi-cylindrical shaped configuration, the intermediate region being formed in a generally flat configuration, the first component forming a recess between the distal region and the proximal end;

a second component having a distal region and a proximal region and an intermediate region there between, the distal region being formed in a thin disc shaped configuration, the proximal region being formed in a semi-cylindrical shaped configuration, the intermediate region being formed in a generally flat configuration, the second component being positionable within the recess of the first component; a post extending upwardly from the intermediate region of the first component to contact a central extent of the intermediate region of the second component when in the closed orientation to preclude pinching during operation and use;

a hinge coupling to the proximal ends of the first and the second components;

an enlarged annular collar having a first half on the first component between the intermediate and proximal regions and a second half on the second component between the distal and proximal regions with a radius of curvature greater than the radius of curvature of the proximal regions; and a spring urging the first and second components into the open orientation during use.

3. The device as set forth in claim 2 and further including:

a distal transition region with a conical configuration between the distal and intermediate regions of the first and second components to facilitate insertion and removal of the device and proximal transition region with a right angle cross sectional configuration between the collar halves and the intermediate regions of the first and second components to preclude over insertion of the device during use.

4. The device as set forth in claim 2 and further including:

an annular groove within the exterior surfaces of the proximal regions of the first and second components adjacent to the collar halves and with an associated elastomeric O-ring positionable there within to hold the first and second components in the closed orientation during storage and transportation but removable therefrom when in use.

* * * * *